US006177140B1

(12) United States Patent
Patil et al.

(10) Patent No.: US 6,177,140 B1
(45) Date of Patent: Jan. 23, 2001

(54) METHOD FOR GALVANIZING AND GALVANNEALING EMPLOYING A BATH OF ZINC AND ALUMINUM

(75) Inventors: Ramchandra S. Patil, Munster, IN (US); Pertti Sippola, Espoo (FI)

(73) Assignee: Ispat Inland, Inc., Chicago, IL (US)

( * ) Notice: Under 35 U.S.C. 154(b), the term of this patent shall be extended for 0 days.

(21) Appl. No.: 09/197,708

(22) Filed: Nov. 23, 1998

Related U.S. Application Data

(63) Continuation-in-part of application No. 09/015,551, filed on Jan. 29, 1998, now Pat. No. 5,958,518.

(51) Int. Cl.[7] ..... B05D 1/18; B05D 3/02

(52) U.S. Cl. ..... 427/433; 427/431; 427/321; 427/434.5

(58) Field of Search ..... 427/431, 433, 427/434.5, 321

(56) References Cited

U.S. PATENT DOCUMENTS

| | | | | |
|---|---|---|---|---|
| 3,323,940 | * | 6/1967 | Sievert | 427/433 |
| 3,619,247 | * | 11/1971 | Newport et al. | 427/433 |
| 3,977,842 | * | 8/1976 | Mayhew | 29/196.5 |
| 4,143,184 | * | 3/1979 | Paulus et al. | 427/300 |
| 4,275,098 | * | 6/1981 | Gunji et al. | 427/345 |
| 4,361,448 | | 11/1982 | Sippola | 148/15 |
| 4,752,508 | * | 6/1988 | Sippola | 427/433 |
| 4,759,807 | | 7/1988 | Sippola | 148/15 |
| 4,913,746 | * | 4/1990 | Marder et al. | 148/127 |
| 4,971,842 | * | 11/1990 | Sippola | 427/433 |
| 5,074,924 | | 12/1991 | Ushioda et al. | 148/11.5 R |
| 5,141,781 | * | 8/1992 | Suzuki et al. | 427/398.1 |
| 5,409,553 | | 4/1995 | Sagiyama et al. | 148/516 |
| 5,518,769 | | 5/1996 | Sagiyama et al. | 427/319 |
| 5,628,842 | | 5/1997 | Wilmotte et al. | 148/526 |
| 5,677,005 | | 10/1997 | Isobe et al. | 427/319 |

FOREIGN PATENT DOCUMENTS

| | | | |
|---|---|---|---|
| 08060327 | 3/1996 | (JP) | C23C/2/28 |

OTHER PUBLICATIONS

Kato et al., *Dross Formation and Flow Phenomena in Molten Zinc Bath*, Galvatech '95 Conference Proceedings, pp. 801–806 (1995).

Yamaguchi et al., *Development of Al Sensor in Zn Bath for Continuous Galvanizing Processes*, Galvatech '95 Conference Proceedings, pp. 647–655 (1955).

* cited by examiner

*Primary Examiner*—Shrive Beck
*Assistant Examiner*—Michael Barr
(74) *Attorney, Agent, or Firm*—Marshall, O'Toole, Gerstein, Murray & Borun

(57) ABSTRACT

The present application discloses a method for hot-dip galvanizing and galvannealing which employs a bath of zinc and aluminum. Strips are immersed in the bath to produce substantially dross-free galvannealed and galvanized strips. The bath can have substantially the same effective aluminum concentration during galvannealing as during galvanizing, and the temperature set-point of the bath is at a temperature of about 440° C. to about 450° C.

18 Claims, 4 Drawing Sheets

METHOD FOR GALVANIZING AND GALVANNEALING EMPLOYING A BATH OF ZINC AND ALUMINUM

This is a continuation-in-part of U.S. application Ser. No. 09/015,551, filed Jan. 29, 1998, now U.S. Pat. No. 5,958, 518.

FIELD OF THE INVENTION

The present invention is directed to methods for galvannealing and galvanizing steel. More particularly, the present invention is directed to methods for continuous hot-dip galvannealing and galvanizing of steel employing a bath of molten zinc and aluminum.

BACKGROUND OF THE INVENTION

In continuous hot-dip galvanizing and galvannealing of steel strip, a bath of molten zinc is employed. Prior to entering the bath, the strip typically undergoes a heat treatment in a furnace. An end portion of the furnace that extends into the bath, called a snout, seals the furnace from the surrounding air. As the strip passes through the snout, the strip becomes immersed in the bath. Typically, two or more rolls are disposed in the molten bath. A sink roll reverses the travel direction of the strip in the bath, and a pair of stabilizing rolls in the bath stabilize and guide the strip through the coating knives.

In the production of galvanized and galvannealed products, aluminum is typically present in the molten zinc bath for controlling zinc-iron alloy growth. Interfacial zinc-iron alloy on galvanized steel is undesirable because it causes low adherence of the zinc coating to the strip. Typically, a relatively low aluminum content is used for galvannealing (e.g., 0.13–0.15wt. %), and a relatively high aluminum content is used for galvanizing (e.g., 0.16–0.2wt. %).

In some conventional processes, two baths are used in a production line in order to produce both galvanized and galvannealed steel. In those processes, one bath is needed to provide a relatively low aluminum content for galvannealing, and a second bath is needed to provide a relatively high aluminum content for galvanizing. However, two baths are disadvantageous because the line must be stopped in order to switch from one bath to the other bath. Also, two baths reduce scheduling flexibility for the production of galvannealed and galvanized steel. Further, a second bath is an extra equipment expense.

In conventional production lines which employ a single bath, the aluminum content is ramped up gradually between galvannealing and galvanizing. This can result in the production of low quality galvanized steel during the transition from galvannealing to galvanizing because, during the transition, the aluminum content may be too low for galvanizing. For example, products with critical surface quality requirements generally cannot be made during the transition, nor can vacuum degassed ultra low carbon steels, which are highly reactive, nor can high strength steels. Moreover, conventional methods generally have poor bath circulation, which results in relatively high variation in composition and temperature in the bath. Such poor circulation can exacerbate the problems encountered during the transition from galvannealing to galvanizing in conventional processes that employ a single bath.

In conventional hot-dip galvanizing processes, an undesirable intermetallic iron-zinc or iron-zinc-aluminum compound, called dross, can form. Dross pick-up on the rolls in the bath, and subsequent transfer to the surface of the strip where it produces pimples and print-through defects, is a major problem with galvanneal products and exposed galvanized products. Surface blemishes caused by dross particles are particularly visible when high gloss paint finishes are applied to the coated steel, which is common in the automotive and appliance industries. Use of cemented carbide-coated rolls in the bath reduces, but does not completely eliminate, these defects.

In addition to causing surface defects, dross formation can directly increase the cost of production. Zinc is one of the most expensive raw materials used in galvanized and galvannealed steel production. Because the weight of the dross generally averages about 8–10% of the zinc consumed during production, production costs are increased.

Conventional methods generally employ baths with high aluminum content for galvanizing and low aluminum content for galvannealing. The low aluminum content of the bath during galvannealing can lead to excessive dross formation and dross pick-up by the strip during galvannealing. Furthermore, accumulation of dross at the bottom of the bath can limit the length of a galvanneal production run and a transition to galvanizing may be required to remove the bottom dross through chemical conversion with a high aluminum addition. If the bottom dross build-up is very heavy, the production line may be shut down for mechanical dross removal.

The high aluminum content of the bath during galvanizing can lead to excessively high aluminum in the coating during galvanizing. High aluminum content for galvanizing is also detrimental to the transition from galvanizing to galvannealing as well as to the reverse transition, because several hours may be required to complete the transition from one aluminum content to another. The transition from galvannealing to galvanizing and vice versa is costly because the change in aluminum content in the bath causes poor quality products during the transition from galvannealing to galvanizing and vice versa. Thus, using conventional methods, it is difficult to make exposed quality coated steel products or vacuum degassed ultra low carbon steels or high strength steels using a single bath for both galvannealing and galvanizing. A reason for the poor surface quality during the transition is that the bottom dross is being converted to top or floating dross as the aluminum content increases during the transition to galvanizing resulting in dross pick-up by the strip.

Although aluminum generally is required in the bath to control iron-zinc alloy growth during galvanizing and galvannealing and to reduce the amount of dross, excess aluminum is not desirable. For instance, too much aluminum in the coating can decrease the spot weldability of the product.

A high temperature in the bath increases the solubility of iron in the bath, which ruins the contents of the bath by causing a formation of both top and bottom dross attributed to iron saturation. In a zinc bath that is saturated with iron, even a small change in the bath temperature causes a precipitation of dross compounds. Thus, it is advantageous to (a) lower the iron content in the zinc bath from a saturated state by using a low and constant galvanizing bath temperature and (b) maintain iron content close to the solubility limit, and thus minimize the precipitation of dross particles from the molten zinc. These particles are a combination of bottom dross ($FeZn_7$) and top dross ($Fe_2Al_5$). These particles are discussed in greater detail in the publication by Kato et al., entitled *Dross Formation and Flow Phenomenon in Molten Zinc Bath*, Galvatech '95 conference proceedings, Chicago, 1995, pages 801–806. This publication is incorporated herein by reference as background material elaborating upon the types of dross particles that are formed in the environment in which the present invention operates.

If the strip is hotter than the bath when the strip is immersed in the bath, the bath can overheat, which causes increased dissolution of iron from the strip into the bath. The strip is hotter than the bath at the snout (i.e., near the point of immersion) unless the strip is sufficiently cooled following the heat treatment that occurs prior to immersion in the bath. In conventional processes, the temperature of the bath is relatively high (e.g., about 460° C.) to avoid freezing of zinc at the bath surface whether a single bath or two baths are employed for galvannealing and galvanizing. Use of a significantly cooler bath or baths, however, can cause zinc to freeze at the bath surface because of poor circulation in conventional baths and because the small difference between the strip immersion temperature and bath temperature.

Both high bath temperatures and dross formation can decrease roll life by increasing abrasion and erosion. Also, other components in the bath, such as bearings and sleeves, have decreased lives because of high bath temperatures and dross formation. The decreased lives of such components increases costs directly (e.g., replacement costs) and indirectly (e.g., cessation of production when replacing the components).

As a result of the above problems, galvanizers using one zinc bath are forced to use special line scheduling (e.g., scheduling to produce exposed quality coated strip while the rolls are new) and maintenance practices (e.g., mechanically cleaning the bath), which are very costly, in order to produce high surface quality products between production runs of low quality galvanized steel and low quality galvannealed steel. Thus, the amount of exposed quality product made using conventional single bath methods is less than the production line's capacity to produce coated strip.

Electrogalvanizing, rather than hot-dip galvanizing, is often employed to produce products intended for use in exposed applications because the electrogalvanizing process conventionally has resulted in better surface quality. However, electrogalvanizing is relatively expensive compared to hot-dip galvannealing or hot-dip galvanizing.

SUMMARY OF THE INVENTION

One method in accordance with the present invention for coating a steel strip comprises the steps of: providing a molten zinc bath having an effective aluminum concentration of about 0.10 wt. % to about 0.15 wt. %; maintaining the set-point of the bath at a temperature of about 440° C. to about 450° C.; circulating molten zinc to homogenize the bath aluminum and temperature and thus prevent the accumulation of dross; immersing the steel strip in the bath to coat the strip, wherein the strip has a snout temperature of about 470° C. to about 538° C.; and directing molten zinc toward the immersed strip to cool the strip.

The method can comprise the steps of maintaining the set-point of the bath at a temperature of about 445° C. to about 450° C., and maintaining the bath temperature within 1° C. of the set-point. The molten zinc bath can have an effective aluminum concentration of 0.13–0.14wt. %. A further aspect of the method is that the surface of the bath can remain entirely molten depending upon the position of the bath heating means (e.g., inductors).

If the strip comprises high strength low alloy steel or low carbon aluminum killed steel, the strip preferably has a snout temperature of about 510° C. If the strip comprises vacuum degassed steel with ultra low or extra low carbon then the strip preferably has a snout temperature of about 471° C.

Another aspect of the present invention is a method for producing galvanized and galvannealed steel having a high quality surface. This method comprises the steps of: providing a molten zinc bath having an effective aluminum concentration; maintaining the set-point of the bath at a temperature of about 440° C. to about 450° C.; and coating steel strips by immersing the strips in the bath to produce substantially dross-free galvanized and galvannealed strips. The effective aluminum concentration of the bath during galvanizing is substantially similar to the effective aluminum concentration of the bath during galvannealing.

In some embodiments, the effective aluminum concentration of the bath varies by no more than 0.01 wt. % between galvannealing and galvanizing. The effective aluminum concentration of the bath during galvanizing can be identical to the effective aluminum concentration of the bath during galvannealing.

The set-point of the bath can be maintained at a temperature of about 445° C. to about 450° C. and the temperature of the bath can be maintained within 1° C. of the set-point. The set-point can be maintained at about 447° C. The effective aluminum concentration in the bath can be about 0.10 wt. % to about 0.15 wt. %, and is preferably 0.13–0.14wt. %. The strips can have immersion or snout temperatures in the range of about 470° C. to about 538° C.

The method can include the steps of directing cool zinc from the bottom of the bath toward the strips being immersed in the bath to prevent the formation of a hot spot adjacent to the immersed strips, thereby preventing zinc vaporization, and rapidly cooling the immersed strips to approach the temperature of the bath.

If a strip comprises high strength low alloy steel or low carbon aluminum killed steel, the strip preferably has a snout temperature of about 510° C. If a strip comprises vacuum degassed steel with ultra low or extra low carbon, the strip preferably has a snout temperature of about 471° C.

The method can produce galvanized and galvannealed products having excellent coating adherence, surface quality, and spot weldability. A surface of the bath can remain entirely molten during coating.

BRIEF DESCRIPTION OF THE DRAWINGS

FIG. 2(*b*) is a schematic diagram depicting a front view of the molten zinc flow control device.

DETAILED DESCRIPTION OF THE PREFERRED EMBODIMENTS

A galvanizing and galvannealing arrangement for processing a continuous steel strip is part of a continuous coating line, and comprises a bath of molten zinc and aluminum. Disposed in the bath is an apparatus for cooling the bath, as discussed more fully below.

The strip can be processed conventionally prior to reaching an end chute, or snout, of the last zone of a soaking furnace. The snout extends into the bath, thereby sealing the furnace from the surrounding air. Such conventional processing prior to reaching the snout can include chemical cleaning by dipping in sodium hydroxide solution and brushing, electrolytic cleaning, rinsing, and drying. Following chemical cleaning, the strip typically is annealed prior to reaching the snout. Jet coolers prior to the snout lower the temperature of the steel to the snout temperature, which is defined as the temperature of the strip as it enters the bath.

Figure 1:
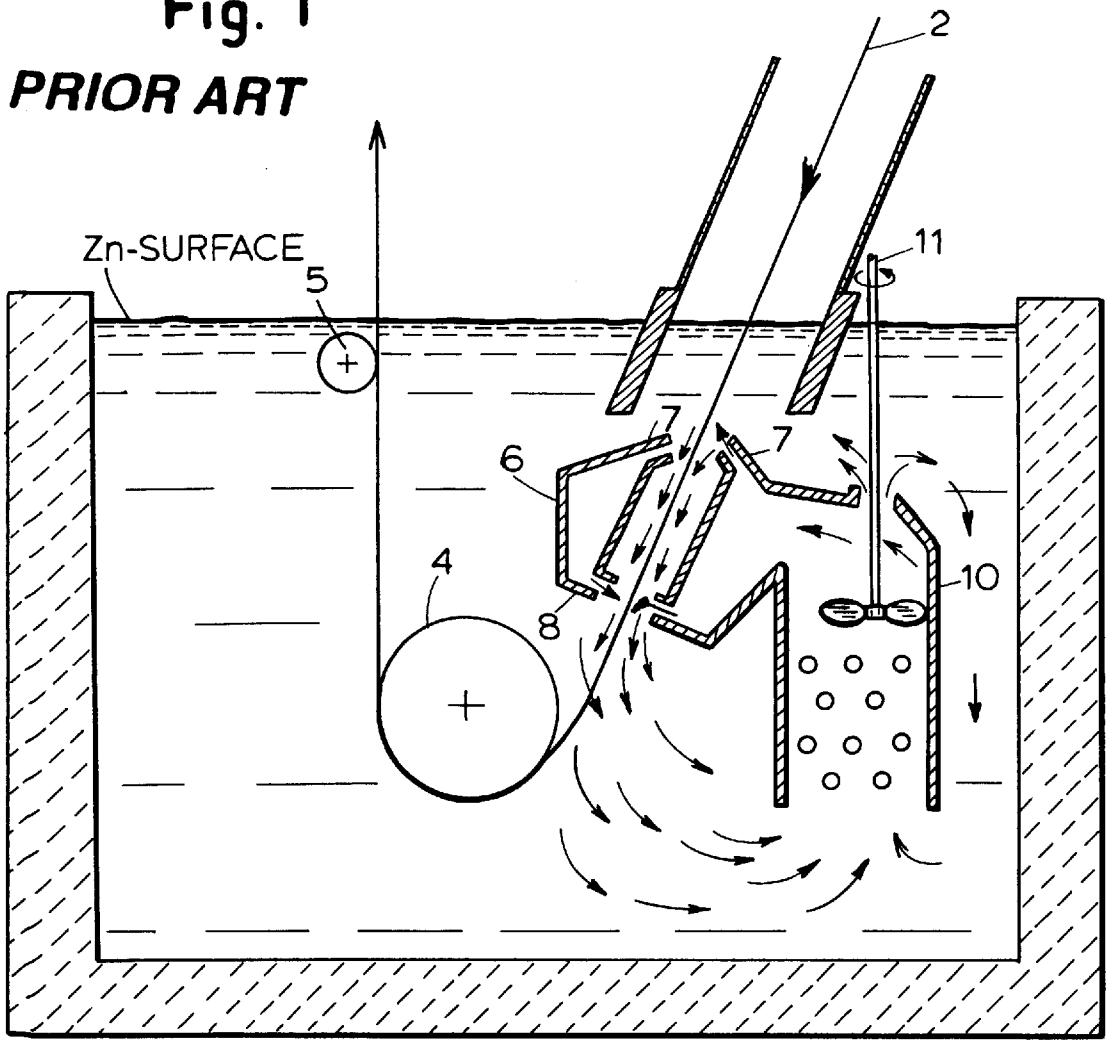
Fig. 1 PRIOR ART
FIG. 1 is a schematic diagram depicting the flow pattern of the system described in U.S. Pat. No. 4,971,842.
Figure 2B:
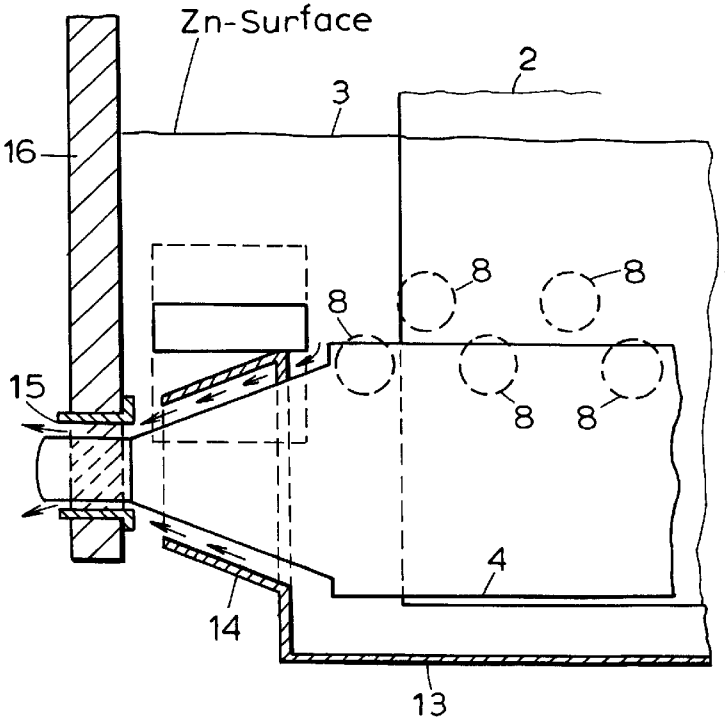
FIG. 2(*a*) is a schematic diagram depicting a side view of the cooler/cleaner of the present invention, and the new flow pattern of the inventive method.
Figure 2A:
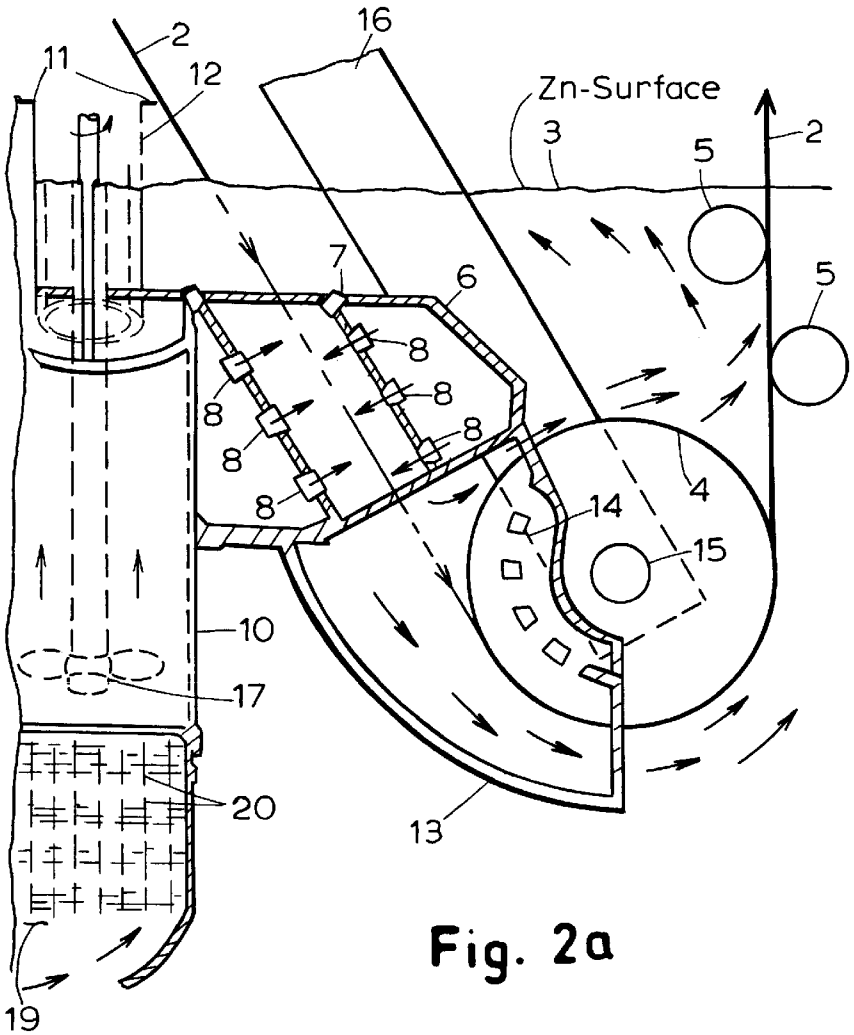

FIG. 1 is a schematic diagram depicting the flow pattern of the system described in U.S. Pat. No. 4,971,842. FIG. 2(*a*) and 2(*b*) depict an overall system suitable for practicing the present invention. As part of the inventive process, an annealed steel strip 2 travels through a zinc bath 3 around a sink roller 4 and between one or more stabilizing rollers 5, which flatten the strip prior to the strip passing between gas jet knives which control the thickness of the coating. A gas medium, such as nitrogen, can be used in the gas jet knives. Following the gas jet knives, gas jet nozzles or water mist nozzles can be used to cool the strip as it emerges from the bath to solidify the coating. The processing steps prior to the strip reaching the snout, and the processing steps after the strip emerges from the bath, can be performed conventionally. U.S. Pat. Nos. 4,361,448, 4,759,807, and 4,971,842, hereby incorporated by reference, disclose arrangements for guiding a strip into a molten bath and out of the molten bath, although none of these patents provides a dross-free bath and a dross-free coating. Another arrangement for guiding a strip into a molten bath and out of the molten bath is disclosed in U.S. patent application Ser. No. 09/015,551, filed on Jan. 29, 1998 and invented by co-inventor Pertti J. Sippola, which is hereby incorporated by reference. That co-pending application also discloses an apparatus for cooling a molten bath, as described below.

Figure 4:
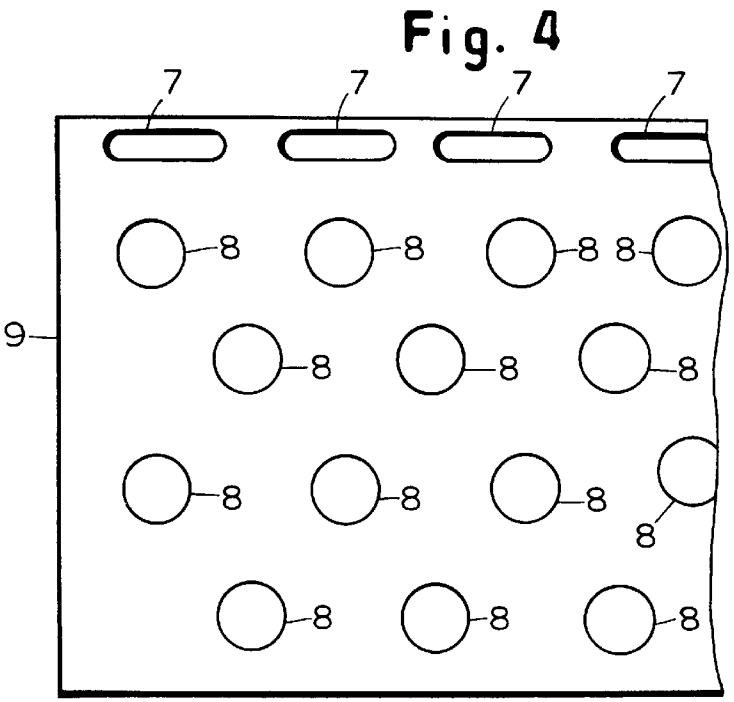
FIG. 4 is a schematic diagram depicting a baffle-plate or plenum containing nozzles.
Figure 3:
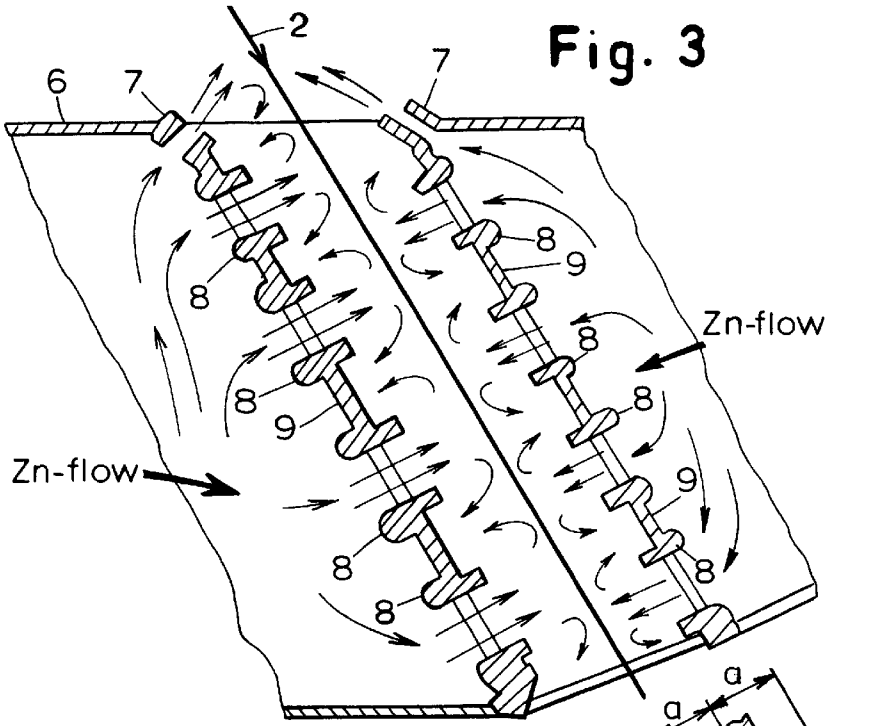
FIG. 3 is a schematic diagram depicting the nozzle chamber of the system of the present invention, and the fluid flow that occurs when carrying out the method of the present invention.
Figure 5A:
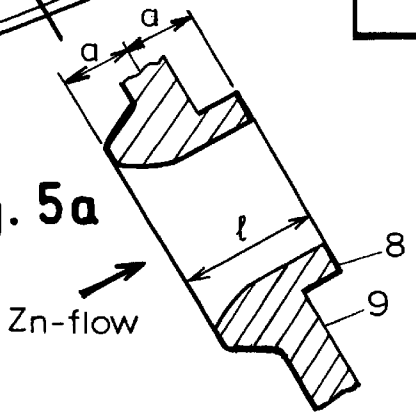
FIGS. 5(*a*) and (*b*) are schematic diagrams depicting two views of the nozzles used to inject the zinc along the length and both sides of the steel strip.
Figure 5B:
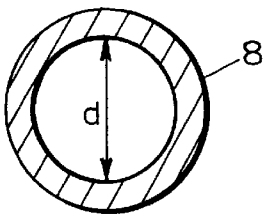

The nozzle unit 6, which applies zinc to the steel, includes upper nozzles 7 and lower nozzles 8 (as depicted in FIGS. 3 and 4). In contrast, the cooler of U.S. Pat. No. 4,971,842 has an upper nozzle 7 and a lower nozzle 8 both formed as slits evenly over the width of the unit 6 without the shadow configuration of plenum plate 9 (FIG. 4) which includes a plurality of nozzles 8 arranged to direct molten zinc at substantially 90° angles along a length of the strip. Further, the cooler/cleaner 2 of the present invention has a plurality of upper elongated nozzles 7, as shown in FIG. 4. Also, the lower nozzles 8 are round and formed in the configuration of plenum plate 9.

The discharge area of the nozzles 7 and 8 should cover at least 50% of the area of steel strip 2 along length of A to B of the steel strip 2 as depicted in FIG. 2(*a*). This is in contrast to the single lower nozzle 8 as described in U.S. Pat. No. 4,971,842 and depicted in FIG. 1. In the system of the present invention the nozzles 8 are mounted in the plenum plate 9 so that a half of the length of the nozzle is on one side and the other half of the other side of the middle-line of the plenum plate. This arrangement provides the most efficient flow of zinc against the steel sheet.

Inside the nozzle chamber 6 the dross contaminated zinc is pumped towards the steel strip in order to adhere the dross particles to the surface of the steel strip 2. This action removes the dross out of the zinc bath as part of the zinc coating on the steel strip. As a result, subsequently processed steel is handled in a dross-free zinc bath since all of the dross has been taken out by adhering to the previously processed steel strips. In order to adhere dross particles effectively to the steel strip, the zinc flow from the nozzles 8 should be directed to strike the strip from a virtually perpendicular direction rather than moving parallel to the strip as is the case for the cooler of U.S. Pat. No. 4,971,842 depicted in FIG. 1.

In order to develop sufficient flow to adhere dross particles to strip 2, the area of the nozzles 8 of the invention should be the same as twice the area of pump housing 10 as measured at agitator 17. By regulating the speed of rotation of the pump, and thus, the volume of material being moved, the velocity of the zinc flow from the nozzles 7 and 8 can be adjusted. The amount of zinc moved to the steel strip 2 can be monitored and controlled by diversion of material (approximately 2% of the total zinc in the bath) from a column of zinc through a slit 12 in housing 11 above the surface 3 of the zinc bath. The slit 12 is preferably 25 mm wide and 100 mm high. Housing 11 is attached to pump housing 10 and extends from below the surface of the zinc bath and extends above the surface of the zinc bath. The zinc level in the slit is diverted from the main zinc flow created by the pump 10, but is indicative of the proper zinc level in the overall bath. Further, by adjusting small amounts of zinc by diverting them from or adding them to the main flow of zinc applied to the steel, it is possible to precisely adjust the levels of zinc for optimum plating and the generation of the least amount of dross. This control device is absent from U.S. Pat. No. 4,971,842.

Preferably a 5 mm column of zinc (above the surface 3 of the bath) correlates with the pumping of 1000 tons of zinc per hour, and a 10 mm column is suitable for 2000 tons of zinc per hour. Below 5 mm, the zinc flow is too small, and above 10 mm the zinc flow is too high creating material erosion problems. Thus, the zinc flow of the invention is assured by maintaining a column of zinc preferably equal to 5 mm to 10 mm at slit 12.

After the processing of three steel coils, as indicated in FIG. 6(*c*), the zinc exiting the nozzle unit 6 is a virtually dross free zinc melt, because virtually all the dross particles have adhered to the steel strip 2 of previously processed coils. Therefore, the zinc flow on either side and below roller 4 cannot create any dross build-up on the roller 4. Nor is there any further dross deposited on strip 2.

The baffle plate 13 is positioned below the lower roller 4. This zinc flow will keep the surface of the lower roller 4 clean, and prevents any dross build up on it. Thus, no mechanical scraper is required, as is necessary with the conventional systems, to remove dross build up from the roller. A cone 14 (FIG. 2(*b*)) at the end of the baffle 13 directs a portion of the dross free zinc flow to the bearing 15 of the sink roller 4 attached to the arm 16. This flow minimizes roller bearing erosion/wear due to hard dross particles that can be in the bath during early stages (first three coils) of processing.

The division of the volume of zinc V handled by pump 10 is illustrated in FIG. 2(*a*). Approximately 40% of the volume of the zinc handled by the pump flows underneath lower roller 4, while approximately 30% flows over the roller. Approximately 15% of the volume of zinc handled by the pump flows out of the top of the nozzle unit 6 on each side of steel strip 2. All of this volume of zinc flows back through the pump, and constitutes approximately 98% of the zinc in the bath. The other 2% is diverted to housing 11, flowing through slit 12.

The area of all of the nozzles 7 and 8 should be substantially equal to twice the area of pump housing 10. Consequently, the zinc flow out of slit 12 is indicative of the critical incremental amounts of zinc that should be available in the bath to achieve the proper process that will result in a dross-free bath and eventually a dross-free product.

The nozzles 8 of the invention are preferably tubular with a diameter of between 70–100 mm and a length more than 0.7 of the diameter of the nozzle. The material of the unit 6 is AISI 316 L (cast) or DIN 1,449. However, it is most important for the unit 6 to be a fully austenitic structure, i.e. ferrite free and the amount of ferrite should be less than 0.2%. Also the material should be cast formed without any bending or cold forming after casting.

The apparatus of the present invention creates the flow pattern as shown in FIG. 2 without any "dead" zones in the zinc bath 3 and with chemical uniformity throughout the zinc bath. This flow pattern makes it possible to achieve a method of performing hot-dip galvanizing with a dross-free zinc bath composition and with minimal localized heating of zinc near the snout. The flow patterns of conventional system and the system such as that shown in FIG. 1, have been insufficient to provide adequate chemical homogeneity, and so cannot achieve a dross-free bath composition and the resulting dross-free product.

The results of these tests on one preferred embodiment of the present invention are provided below, and in FIGS. 6(*a*)–6(*b*), to illustrate some of the specific details of the inventive system and the process of operating it to galvanize steel strip. Industrial scale trials have been carried out to compare the cooler of U.S. Pat. No. 4,971,842 with the cooler/cleaner of the present invention. If the strip immersion temperature is too high, the reactivity of the bath will become too high, resulting in suspended dross. The system of the present invention operates to achieve the dross-free bath and subsequent dross-free product at reasonable strip immersion temperatures, preferably about 470° C. to about 538° C. for the temperature of the steel strip, preferably about 440° C. to about 450° C. for the set-point of the bath temperature, and more preferably about 445° C. to about 450° C. for the set-point of the bath temperature. When the bath temperature is less than about 445° C., some freezing of zinc can occur at the surface of the bath which makes removal of the top dross by skimming more difficult.

As seen in FIG. 2(*a*), the bath cooler includes a primary heat exchanger 19 which comprises a bundle of U-shaped stainless steel tubes 20 carrying nitrogen and deionized water as coolant through the bath. The coolant (enclosed by the tubes 20) enters the bath at about 90° C. to about 100° C. and exits the bath at about 250° C. to about 350° C. A secondary heat exchanger (not shown) outside of the bath reduces the temperature of the coolant from a range of about 250° C. to about 350° C. to a range of about 30° C. to about 50° C. Then, after a blower recirculates the atmosphere back into the primary heat exchanger 19, the coolant is returned to the bath at a temperature of about 90° C. to about The apparatus thus can control the temperature of the zinc flowing through the nozzles to be 0.1–3 degrees Celsius below the operating temperature of the zinc bath. The operating temperature of the zinc bath is maintained ±1° C. from the set-point. When the set-point is maintained constant, there is no transition of the bath temperature and the temperature of the bath is said to be at steady state.

The upper nozzles 7 direct the zinc flow obliquely towards the steel strip, preferably against the travel direction thereof, preventing the warming of zinc within the snout and preventing the formation of zinc vapors in the furnace, which ultimately prevents the formation of dross in the bath, and improves coating adherence. The lower nozzles 8 direct the zinc flow and can, for example, direct the flow perpendicularly towards the steel strip. The total amount of the zinc flow can be controlled by means of the speed of rotation of the pump 10.

Two agitators or impellers 17 located in the pump 10 on either side of the U-shaped stainless steel tubes 20 draw relatively cool zinc upwardly from the bottom of the bath to pass through the nozzles near the snout. The cool zinc then cools the strip quickly as the strip enters the bath. Also, because the zinc is being circulated by the agitators 17, localized heating of zinc near the snout is minimized or prevented.

As shown in the Table I the cooler/cleaner can produce a product with dross-free coating.

TABLE I

| | Conventional Cooler | | Inventive Cooler/Cleaner | |
|---|---|---|---|---|
| Strip immersion | 540° C. | 485° C. | 540° C. | 485° C. |
| Bath temperature | 447° C. | 447° C. | 447° C. | 447° C. |
| Aluminum content in bath | .15% | .15% | .14% | .14% |
| Iron content in bath | .03% | .025% | .025% | .020% |
| Dross -- % in coating (by line inspector) | 2–3 | 1–2 | 1 | 0 |

The aluminum and iron content have been measured by chemical analysis from the samples taken out of the zinc bath. The solubility of iron to zinc at 447° C. is 0.020 wt-% when aluminum content is 0.14%. Thus the iron content of the bath is equal to the solubility of iron. As a result the method of the invention is capable of maintaining a dross-free zinc bath to produce a dross free product.

Figure 6A:
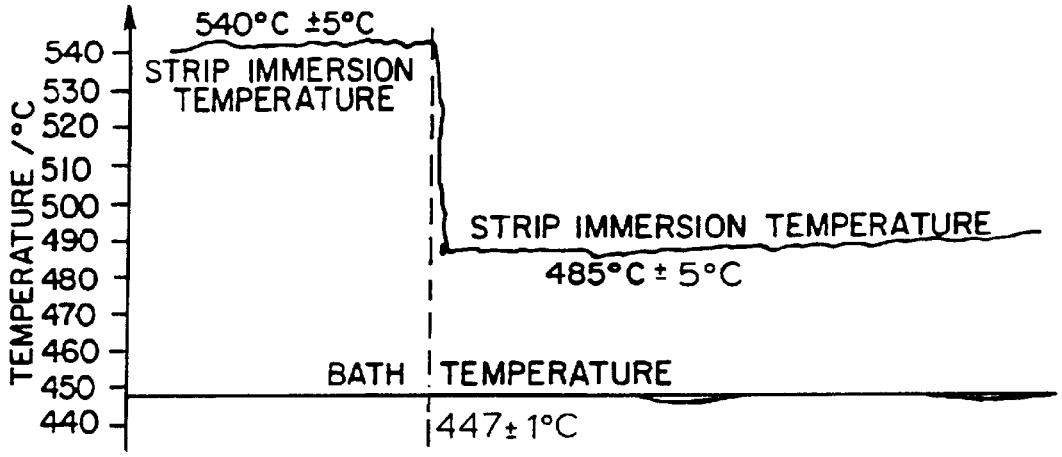
FIGS. 6(*a*)–6(*c*) are process diagrams depicting a comparison of various operational aspects of the conventional art and the present invention.
Figure 6B:
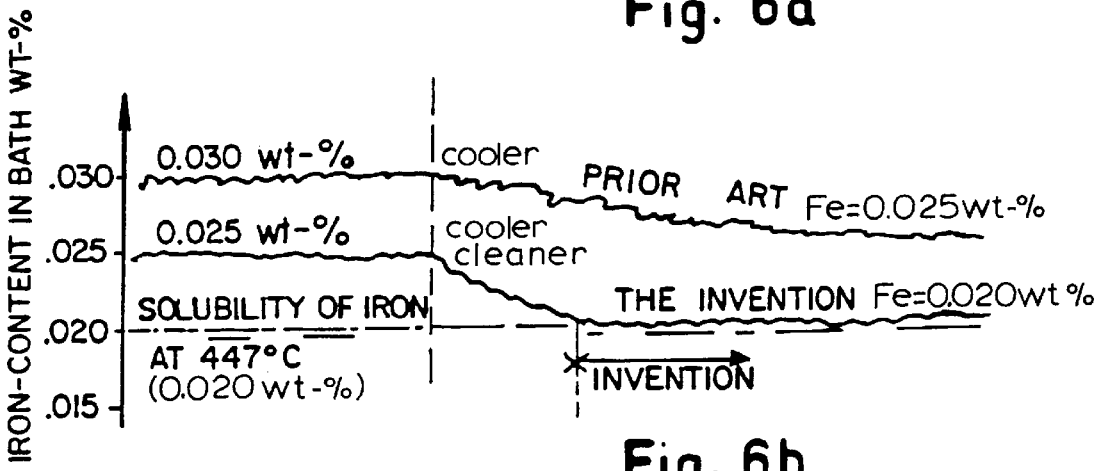
Figure 6C:
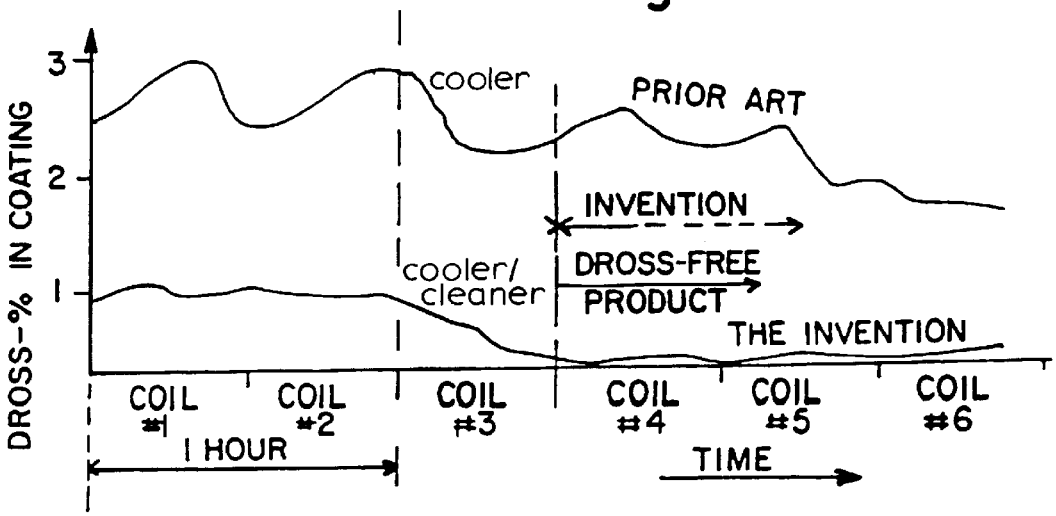

The three graphs of FIGS. 6(a)–(c) depict the results of using the present invention as opposed to those occurring when the system of U.S. Pat. No. 4,971,842 is used. In particular, the effectiveness (effectiveness=dross removal per unit time) of the system of the present invention is superior compared to that of U.S. Pat. No. 4,971,842. This is illustrated by the graph in FIG. 6(*c*), illustrating dross removal over a period of time, for a plurality of coils being processed. Each of the coils is approximately 20 tons of steel and takes approximately 30 minutes to process. By the time the third coil is processed, the operation of the present invention is such as to rapidly remove dross particles from the iron-saturated zinc bath. Subsequently, coil 4 becomes the first coil processed in a dross-free environment, which is the object of the present invention. This result has been impossible to achieve with the system of U.S. Pat. No. 4,971,842.

In many conventional processes, the strip must be cooled to about 460° C. in the snout to avoid iron-zinc alloy formation on the strip while in the bath. Because the present invention minimizes strip cooling prior to strip immersion, as shown by the two examples immediately below, the throughput of the strip can be increased.

For a strip composed of high strength low alloy steel or regular low carbon aluminum killed steel, the strip immersion temperature or the snout temperature for both galvannealing and galvanizing can be as low as about 471° C., is preferably about 510° C., and can be up to about 538° C. Near 538° C., however, zinc vaporization can begin to occur and there is a slight increase in dross formation.

For a strip composed of vacuum degassed steels, both stabilized and non-stabilized, the strip temperature at immersion or at the snout for both galvannealing and galvanizing is preferably about 471° C., but can be from about 471° C. to about 510° C. At higher temperatures, more iron-zinc alloy growth occurs.

In both examples immediately above, a bath temperature of 447° C. is preferred but any bath temperature in the range of about 445° C. to about 450° C. is suitable.

The effective aluminum concentration in the bath is close to, and to the right of, the knee point of the iron-zinc-aluminum ternary solubility diagram. Effective aluminum does not include aluminum that is tied up in intermetallic alloys. In other words, effective aluminum is defined as aluminum in solution in the bath which can control iron-zinc alloy formation between the coating and the steel. Effective aluminum concentrations of about 0.10 wt. % to about 0.15 wt. % are suitable for use in accordance with the present invention for the production of both galvannealed and galvanized steel from the same molten bath. Preferred effective aluminum concentrations are from 0.12 to 0. 15wt. % for the production of both galvannealed and galvanized steel from the same molten bath, and more preferred effective aluminum concentrations are from 0.13 to 0.14wt. %. Effective aluminum concentrations were measured using a dynamic sensor which was developed by the Nagoya Institute of Technology and which was described in the article *Development of Al Sensor in Zn Bath for Continuous Galvanizing Processes* by S. Yamaguchi, N. Fukatsu, H. Kimura, K. Kawamura, Y. Iguchi, and T. O-Hashi, Galvatech 1995 Proceedings, pp. 647–655 (1995). The dynamic sensor was manufactured by Yamari Industries Ltd. of Japan and was marketed by Cominco.

If the effective aluminum concentration is just to the right side of the knee point of the iron-zinc-aluminum ternary solubility diagram, dross formation is acceptably low (dross formation generally decreases with increasing aluminum content) and transitions from galvanizing to galvannealing and vice versa are relatively easy. Further, the relatively low aluminum content that results from operating just to the right of the knee point of the iron-zinc-aluminum solubility diagram results in a product with lower aluminum in the coating than that produced conventionally which leads to improved spot weldability.

The aluminum concentration of conventionally produced coatings typically is 2.5 to 4 times the aluminum concentration of the bath depending on the bath temperature, the strip temperature, coating weight, and other factors. The aluminum concentration of the coatings produced by the present invention varies between about 1.5 to 2.5 times the aluminum concentration of the bath.

In the bath of the present invention, temperature and composition uniformity are important, and bath circulation helps attain both of those features. In conventional methods, only the movement of the strip and the rolls in the bath, and the force caused by the bath inductors, result in zinc circulation. Such minimal circulation leads to uneven temperatures and a non-uniform composition throughout the bath. Also, because aluminum is lighter than zinc, aluminum flows to the surface of the bath, further increasing the non-uniformity of composition.

When operating near the knee point of the iron-zinc-aluminum ternary diagram using conventional methods, there are several gradients in the bath. Further, if aluminum in a conventional method is low, then iron content increases. Therefore, more bottom dross forms. Also, high bath temperature and high temperature variation can lead to dross formation.

Employing the methods of the present invention, coating adherence is improved because of a thinner iron-zinc alloy layer with low aluminum content. Improved adherence was achieved with coating weights of 88 and 145 g/m$^2$/side. Also, a superior surface quality resulted because there was virtually no dross pick-up by the strip during steady-state conditions. Also, the strip speed on the line (or throughput) was faster, because the process was not limited to the rate of jet cooling prior to strip immersion.

The weight of the dross formed averaged only about 6 to 7% of the zinc consumed during the above examples of the present invention compared to about 8 to 10% in conventional coating processes. While conventional galvanizing methods employing less than 0.15% aluminum in the molten bath typically produce strip having poor coating adherence and a lot of dross pick-up, the present method produces galvanized strip with excellent coating adherence and virtually no dross pick-up while employing less than 0.15% aluminum.

Moreover, the high surface quality galvanized steel was coated in the same molten bath (with substantially the same effective aluminum concentration) as the galvannealed steel. The effective aluminum concentration during the coating for galvannealing is substantially the same as the effective aluminum concentration during the coating for galvanizing. Substantially the same, in that context, means that no aluminum brightener had been added from an external source between galvannealing and galvanizing, and no steps (e.g., adding pure zinc) were taken to reduce the aluminum concentration between galvannealing and galvanizing. Variations of ±0.005% aluminum can be expected because of small, localized aluminum concentration variation at the locations where effective aluminum concentration is measured. Thus, multiple readings of effective aluminum concentration should be taken to attain an average effective aluminum concentration. In some embodiments, the effective aluminum concentration of the bath varies by no more than 0.01 wt. % between galvannealing and galvanizing.

Coating adherence can be determined by exposing the galvanized strip to a severe impact to produce a dent and then applying SCOTCH® tape to the impacted area. If no cracking or flaking occurs then the coating adherence is considered to be excellent. Dross pick-up is visually determined by examining the surface of the coated strip for pimples which indicate the presence of dross. A substantially dross-free coated strip is defined as a coated strip that has no pimples detectable by visual inspection.

In conventional processes, low aluminum in the bath causes excessive iron-zinc alloy growth which, in turn, causes low adherence of the coating to the strip. Low aluminum in the bath in conventional processes also causes excessive dross formation. In contrast, in the present methods, low aluminum in the bath can be employed without dross formation because the low and constant bath temperature and the uniform bath composition decrease the bath iron content close to the iron solubility limit. The low and constant bath temperature and the uniform bath composition result from the bath cooling apparatus discussed above. The low bath temperatures achieved by the present invention would cause zinc to freeze near the surface if employed in conventional methods.

In the present method, low iron-zinc alloy growth is achieved because more effective aluminum is present in the bath and the bath temperature can be lower than conventional methods. Although conventionally the coating for galvanized steel is higher in aluminum content than is the coating for galvannealed steel, the present invention permits the production of high surface quality galvanized coatings without much iron content (i.e., with good adherence) in a bath having effective aluminum content in the galvannealing range. Thus, the present method allows the same bath to be employed to produce both galvannealed and galvanized steel, wherein the bath has substantially the same effective aluminum concentration during galvanizing as during galvannealing.

A new or unused bath is initially dross-free. However, a bath which had previously been used for conventional galvannealing and galvanizing methods contains some dross. To remove dross such that a previously used bath can be used to produce substantially dross-free coated strip, one or more coils can be run through the bath. Such a coil or coils will pick up dross, ridding the bath of dross for subsequent coils. Once the dross has been removed, the present invention permits production of galvanized and galvannealed steel for extended periods of time without dross being picked up by the surface of the steel. Some top dross can form while employing the present method. However, this can be removed by skimming the surface of the bath.

Employing the present method, roll life is increased as is the life of bearings and sleeves of the coating apparatus. The increased life of that equipment is from less dross and from the use of a lower bath temperature which reduces erosion. The increased equipment life results in increased production because the rolls work for a longer period of time. Additionally, there is a reduction in roll replacement costs.

Thus, the present invention allows faster product transitions from galvannealing to galvanizing and vice versa, higher quality galvanized strip produced during the transition from galvannealing to galvanizing, and, because of the lower bath temperature which decreases iron solubility, the surface quality of the coated strip is better than conventionally produced coated strip even during steady-state conventional production. Further, throughput can be increased to furnace capacity, thereby increasing the speed of production lines previously limited by jet cooling capacity. Yield of substantially defect-free product can be increased because fewer dross deposits appear on the rolls and, consequently, fewer coating defects are produced.

Although preferred embodiments have been described by way of example, the present invention should not be construed as being limited thereby. Consequently, the present invention should be considered to include any and all equivalents, modifications, variations and other embodiments limited only by the scope of the appended claims.

What is claimed is:

1. A method of producing galvanized or galvannealed steel from a single zinc bath comprising the steps of:

providing a molten zinc bath having an effective aluminum concentration of about 0.10 wt % to about 0.14 wt %;

maintaining a set-point of the bath at a temperature of about 440° C. to about 450° C. wherein the bath temperature is maintained within 1° C. of the set point;

circulating molten zinc to prevent an accumulation of dross in the bath;

immersing the steel strip in the bath to coat the strip, wherein the strip has a snout temperature of about 470° C. to about 538° C.; and continuously directing a sufficient amount of molten zinc toward the immersed strip to cool the strip.

2. The method of claim 1 wherein the set-point of the bath is maintained at a temperature of about 445° C. to about 450° C.

3. The method of claim 1 wherein the molten zinc bath has an effective aluminum concentration of 0.13–0.14 wt. %.

4. The method of claim 1 wherein a surface of the bath is entirely molten.

5. The method of claim 1 wherein:

the strip comprises a high strength low alloy steel or low carbon aluminum killed steel; and the strip has a snout temperature of about 510° C.

6. The method of claim 1 wherein:

the strip comprises vacuum degassed steel with extra low carbon; and the strip has a snout temperature of about 471° C.

7. A method of producing galvanized or galvannealed steel having a high quality surface from a single zinc bath, the method comprising the steps of:

providing a molten zinc bath having an effective aluminum concentration of about 0.10 wt % to about 0.14 wt %;

maintaining a set-point of the bath at a temperature of about 440° C. to about 450° C., wherein the bath temperature is maintained within 1° C. of the set-point;

coating steel strips by immersing the strips in the bath to produce substantially dross-free galvanized or galvannealed strips;

wherein the effective aluminum concentration of the bath for the production of a galvanized strip is substantially similar to the effective aluminum concentration of the bath for the production of a galvannealed strip.

8. The method of claim 7 wherein the effective aluminum concentration of the bath varies by no more than 0.01 wt. % between galvannealing and galvanizing.

9. The method of claim 7 wherein the effective aluminum concentration of the bath during galvanizing is identical to the effective aluminum concentration of the bath during galvannealing.

10. The method of claim 7 wherein the set-point of the bath is maintained at a temperature of about 445° C. to about 450° C.

11. The method of claim 10 wherein the set-point is maintained at about 447° C.

12. The method of claim 7 wherein the effective aluminum concentration of the bath is 0.13–0.14wt. %.

13. The method of claim 7 wherein the strips have a snout temperature in the range of about 470° C. and about 538° C.

14. The method of claim 13 wherein:

the strips comprise a high strength low alloy steel or a low carbon aluminum killed steel; and the strips have a snout temperature of about 510° C.

15. The method of claim 13 wherein:

the strips comprise a vacuum degassed steel with extra low carbon; and the strips have a snout temperature of about 471° C. ° C.

16. The method of claim 7 wherein the galvanized and galvannealed strips have excellent coating adherence.

17. The method of claim 7 wherein a surface of the bath is entirely molten.

18. The method of claim 7 further comprising the step of:

continuously directing cool zinc from a bottom of the bath toward the strips being immersed in the bath to prevent the formation of a hot spot adjacent to the immersed strips, and to sufficiently cool the immersed strips to approach the temperature of the bath.

* * * * *

UNITED STATES PATENT AND TRADEMARK OFFICE

CERTIFICATE OF CORRECTION

PATENT NO. : 6,177,140 B1
DATED : January 23, 2001
INVENTOR(S) : Patil et al.

It is certified that error appears in the above-identified patent and that said Letters Patent is hereby corrected as shown below:

Column 12,
Line 55, replace "471° C. ° C." with "471° C".

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*